US012606942B1

(12) United States Patent
Cai et al.

(10) Patent No.: US 12,606,942 B1
(45) Date of Patent: Apr. 21, 2026

(54) SHEDDING MECHANISM STRUCTURE, WEAVING MACHINE COMPRISING THE SAME, FABRIC, AND METHOD FOR WEAVING

(71) Applicant: Dayi Warp Knitting Co., Ltd., Quanzhou (CN)

(72) Inventors: Jincheng Cai, Quanzhou (CN); Qingshun Cai, Quanzhou (CN); Yunfeng Huang, Quanzhou (CN); Siyan Liu, Quanzhou (CN)

(73) Assignee: Dayi Warp Knitting Co., Ltd., Quanzhou (CN)

( * ) Notice: Subject to any disclaimer, the term of this patent is extended or adjusted under 35 U.S.C. 154(b) by 0 days.

(21) Appl. No.: 19/337,914

(22) Filed: Sep. 24, 2025

(30) Foreign Application Priority Data

Dec. 4, 2024 (CN) ..... 202411769248.4
Dec. 4, 2024 (CN) ..... 202422985182.4

(51) Int. Cl.

| | |
|---|---|
| ***D03D 13/00*** | (2006.01) |
| ***D03C 3/26*** | (2006.01) |
| ***D03C 9/02*** | (2006.01) |
| ***D03C 9/06*** | (2006.01) |
| *D03C 7/00* | (2006.01) |

(52) U.S. Cl.
CPC ..... *D03C 9/024* (2013.01); *D03C 3/26* (2013.01); *D03C 9/06* (2013.01)

(58) Field of Classification Search
CPC ..... D03C 9/024; D03C 3/26; D03C 9/06
See application file for complete search history.

(56) References Cited

U.S. PATENT DOCUMENTS 1,033,507 A * 7/1912 Wood ..... D03C 7/00 139/51
1,057,748 A * 4/1913 Linnertz ..... B21F 99/00 140/72
1,142,751 A * 6/1915 Crompton ..... D03D 51/22 139/356
1,594,542 A * 8/1926 Manley ..... D03C 7/00 139/93
2,541,745 A * 2/1951 Carragher ..... D03C 7/00 139/96

(Continued)

FOREIGN PATENT DOCUMENTS

CN 104005152 A 8/2014
CN 104233586 A 12/2014

(Continued)

*Primary Examiner* — Robert H Muromoto, Jr.
(74) *Attorney, Agent, or Firm* — Vanguard IP LLC; Michael D. Eisenberg

(57) ABSTRACT

The present application belongs to the field of textile technology and particularly relates to a shedding mechanism structure, a weaving machine including the same, a fabric, and a method for weaving fabric. The shedding mechanism structure includes independently liftable shedding arms and half shedding frame. The shedding arms include a front base shedding frame and a rear base shedding frame, the front base shedding frame and the rear base shedding frame are each provided with a movable part. The movable part is provided with a movable hole, the half shedding frame is liftably mounted between the front base shedding frame and the rear base shedding frame through the moveable hole.

3 Claims, 10 Drawing Sheets

(56) References Cited

U.S. PATENT DOCUMENTS

| | | | | | |
|---|---|---|---|---|---|
| 3,220,441 | A | * | 11/1965 | Kaufmann | D03C 9/0633 139/92 |
| 3,258,035 | A | * | 6/1966 | Fend | D03C 9/0608 139/92 |
| 3,640,314 | A | * | 2/1972 | Strauss | D03D 47/267 139/55.1 |
| 4,076,050 | A | * | 2/1978 | Strauss | D03D 47/267 139/436 |

FOREIGN PATENT DOCUMENTS

| | | | |
|---|---|---|---|
| CN | 204023085 | U | 12/2014 |
| CN | 106884247 | A | 6/2017 |
| CN | 109554807 | A | 4/2019 |
| KR | 20140060085 | A | 5/2014 |

* cited by examiner

SHEDDING MECHANISM STRUCTURE, WEAVING MACHINE COMPRISING THE SAME, FABRIC, AND METHOD FOR WEAVING

TECHNICAL FIELD

The present application relates to the field of textile technology, and particularly relates to a shedding mechanism structure, as well as a weaving machine comprising the same, fabric, and method for weaving.

BACKGROUND

Weaving machine is a device that interlaces heddled warp yarn and weft yarn to produce fabric. When the weft yarn passes through, a portion of the heddled warp yarn is raised, creating an opening (shed) between the heddled warp yarns. The weft yarn passes through this shed, thereby enabling the weaving of fabric.

The fabric structures produced by different types of weaving machines comprise leno weave and Jacquard weave. Leno weave refers to a fabric structure in which two systems of heddled warp yarn (ground and leno) are twisted with a single system of weft yarn, resulting in mutual twisting of the heddled warp yarns. The openings formed by this twisting on the leno fabric are referred to as leno holes. Jacquard weave refers to the formation of patterns or motifs by regulating the floatation and interlacing of heddled warp yarn or weft yarn on the surface of the fabric or within its structure according to specified rules.

Although conventional weaving machines are capable of combining leno weave and Jacquard weave to produce novel fabric structures, the leno weave in such fabrics is typically of a single configuration, and the air holes formed in the leno weave are of uniform size, with the yarn structure unable to be adjusted according to actual requirements during the weaving process. This results in a lack of diversity in the fabric composed of such structures.

SUMMARY

The present application discloses a shedding mechanism structure, a weaving machine comprising the same, a fabric, and a corresponding method for weaving, which mainly addresses the problem that, in the existing traditional looms, the leno weave structure of the woven fabric is single in form, resulting in a lack of diversity in the fabric.

To achieve the above objective, the shedding mechanism structure provided by the present application comprises independently liftable shedding arms and a half shedding frame. The shedding arms comprise a front base shedding frame and a rear base shedding frame, each provided with a movable part. The movable part is provided with a movable hole. The half shedding frame is liftably mounted between the front base shedding frame and the rear base shedding frame via the movable hole. The half shedding frame comprises a shedding head and a shedding foot, and is further provided with a heddle eye.

Preferably, the apparatus comprises a machine frame, which comprises a front frame body and a rear frame body. The front frame body is provided with a warp guiding mechanism, while the rear frame body is provided with a warp beam. The warp beam is configured to wind and feed the first heddled warp yarn and the second heddled warp yarn. The warp guiding mechanism comprises a plurality of independently arrayed ground shedding frames and a plurality of shedding mechanism structures.

Preferably, the apparatus further comprises a weft insertion part for driving the weft yarn. One end of the ground shedding frame is connected to a Jacquard part for driving the ground shedding frame, and the other end is connected to a reset part for resetting the ground shedding frame.

Preferably, the ground shedding frame comprises a liftable shedding plate and a warp guide hole provided on the shedding plate. The upper end of the shedding plate is connected to the Jacquard part, and the lower end is connected to the reset part. The upper ends of the front base shedding frame and the rear base shedding frame are connected to the Jacquard part, while the lower ends of the front base shedding frame, rear base shedding frame, and half shedding frame are connected to the reset part.

Preferably, the fabric comprises a body region and a mesh region, wherein the mesh region is provided with a mesh weave and a Jacquard weave.

Preferably, when utilizing the weaving machine with the shedding mechanism structure, the method comprises the following steps:

Weaving of a body region: under the condition that the first heddled warp yarn and the second heddled warp yarn do not interfere with each other, the ground shedding frame drives the first heddled warp yarn to form a shed for inserting the weft yarn, while the shedding mechanism structure drives the second heddled warp yarn to form a shed for inserting the weft yarn, thereby interweaving to form the body region of the fabric.

Weaving of a mesh region: at least two of the first heddled warp yarn are selected to form a first unit warp bundle, such that the second heddled warp yarn and the first unit warp bundle together form a shed for inserting the weft yarn. Through the movement of the shedding mechanism structure, the front base shedding frame, and the rear base shedding frame, the second heddled warp yarn within the heddle eye forms a second unit warp bundle, and the second unit warp bundle is entwined with the weft yarn on the first unit warp bundle to form the mesh weave.

Preferably, the front base shedding frame and the rear base shedding frame of the shedding mechanism structure are controlled to rise or fall during the weaving process by means of a Jacquard part hole, thereby controlling the opening and closing of the heddle eye.

Preferably, the first heddled warp yarn passes through the warp guide holes on the ground shedding frame and the heddle eye on the shedding mechanism structure, respectively, while the second heddled warp yarn passes through the warp guide hole of the ground shedding frame and then between the front base shedding frame and the rear base shedding frame of the shedding mechanism structure.

Preferably, the process of weaving the body region specifically comprises adjusting the relative positions of the first heddled warp yarn and the second heddled warp yarn by means of the ground shedding frame, such that the horizontal elevations of the first heddled warp yarn and the second heddled warp yarn are different and do not interfere with each other, and driving the ground shedding frame to rise or fall by means of the Jacquard part and the reset part, so that the first heddled warp yarn, together with the ground shedding frame, forms a shed for inserting the weft yarn.

Preferably, the process of weaving the mesh region specifically comprises adjusting the relative positions of the first heddled warp yarn and the second heddled warp yarn by driving the shedding mechanism structure by means of the Jacquard part and the reset part, such that the horizontal elevation of the first heddled warp yarn and the second heddled warp yarn are different and do not interfere with each other, and driving the front base shedding frame of the shedding mechanism structure to rise and the rear base shedding frame to fall by means of the Jacquard part and the reset part, thereby closing the heddle eye and bundling the second heddled warp yarn within the heddle eye into a second unit warp bundle, simultaneously, the first heddled warp yarn slides upward along the edge of the half shedding frame with the front base shedding frame and ultimately slides between the rear base shedding frame and the half shedding frame, and the first heddled warp yarn and the second heddled warp yarn intersect and are fixed by the weft yarn to form the mesh weave.

Preferably, during the process of weaving the body region, the shedding mechanism structure is controlled by the Jacquard part and the reset part to fall the front base shedding frame and raise the rear base shedding frame, open the heddle eye, and utilize the ground shedding frame to perform Jacquard weaving on the second heddled warp yarn to form a Jacquard weave.

The technical solution provided by the present application at least achieves the following technical effects:

During the weaving process, the present application enables independent raise or fall of the front and rear base shedding frames of the shedding mechanism structure via the Jacquard part and the reset part, thereby controlling the opening and closing of the heddle eye. The configuration of the heddled warp yarn within the heddle eye can be adjusted according to actual weaving requirements, allowing the resulting fabric to exhibit a greater diversity of structural forms and enhancing the fabric's sense of layering.

In the present application, the shedding mechanism structure is configured with three independent movable parts, enabling the opening and closing of the heddle eye to be controlled by the movement of the front and rear base shedding frames during the weaving process. The heddle eye can accommodate two or more heddled warp yarns, and, through the vertical actuation of multiple ground shedding frames, a shed suitable for the insertion of weft yarn can be formed. This configuration allows for the weaving of various fabric patterns within a single shedding group.

BRIEF DESCRIPTION OF THE DRAWINGS

To more clearly illustrate the technical solutions of the embodiments of the present application, the drawings required for the description of the embodiments, or the prior art are briefly introduced below. It is evident that the drawings described herein represent only certain embodiments of the present application. Those skilled in the art may derive other drawings from these without the exercise of inventive effort.

Figure 1:
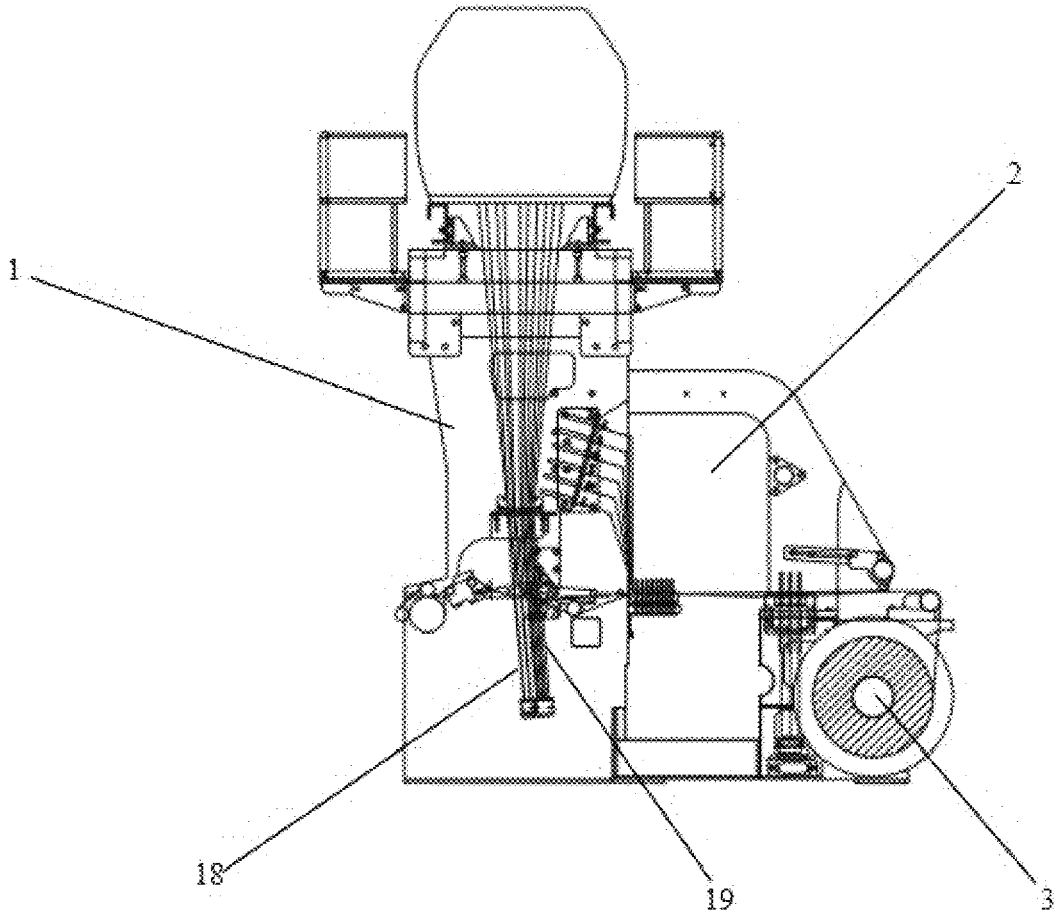
FIG. 1 is a schematic structural diagram of the weaving machine according to Embodiment 2 of the present application.

Reference numerals: 1. Front frame body; 2. Rear frame body; 3. Warp beam; 4. Front base shedding frame; 5. Rear base shedding frame; 6. Heddle eye; 7. Movable part; 8. Shedding foot; 9. Shedding head; 10. First heddled warp yarn; 11. Second heddled warp yarn; 12. First warp stop motion; 13. Second warp stop motion; 14. Body region; 15. Perforated region; 16. Weft yarn; 17. Half shedding frame; 18. Ground shedding frame; 19. Shedding mechanism structure.

DETAILED DESCRIPTION

The embodiments of the present application are described in detail below, with exemplary embodiments illustrated in the accompanying drawings, in which identical or similar reference numerals throughout denote identical or similar elements, or elements having identical or similar functions. The embodiments described below with reference to the accompanying drawings are exemplary and are intended to illustrate embodiments of the present application and should not be construed as limiting the present application.

In the description of the embodiments of the present application, it should be understood that terms such as 'length', 'width', 'upper', 'lower', 'front', 'rear', 'left', 'right', 'vertical', 'horizontal', 'top', 'bottom', 'inner', 'outer', and the like, indicating orientations or positional relationships, are based on the orientations or positional relationships shown in the accompanying drawings, and are provided solely for the convenience of describing the embodiments of the present application and for simplifying the description. They are not intended to indicate or imply that the referenced device or element must have a particular orientation, or be constructed or operated in a particular orientation, and therefore should not be construed as limiting the present application.

Furthermore, the terms 'first' and 'second' are used solely for descriptive purposes and should not be construed as indicating or implying relative importance, nor as implicitly specifying the quantity of the indicated technical features. Accordingly, features designated as 'first' or 'second' may expressly or implicitly comprise one or more of said features. In the description of the embodiments of the present application, the term 'a plurality of denotes two or more, unless otherwise specifically defined.

Embodiment 1

Figure 2:
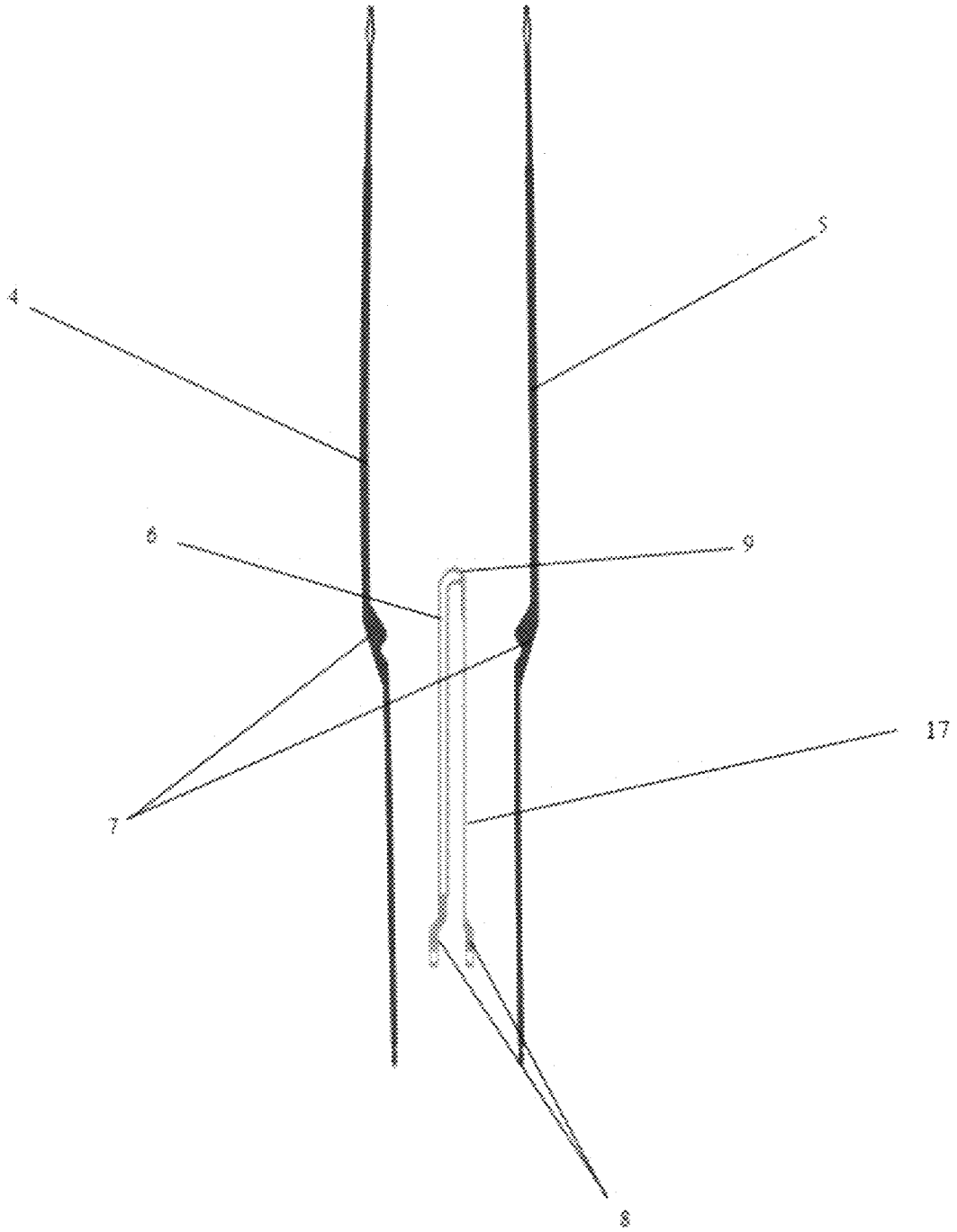
FIG. 2 is a schematic structural diagram of the shedding mechanism structure according to Embodiment 1 of the present application.
Figure 3:
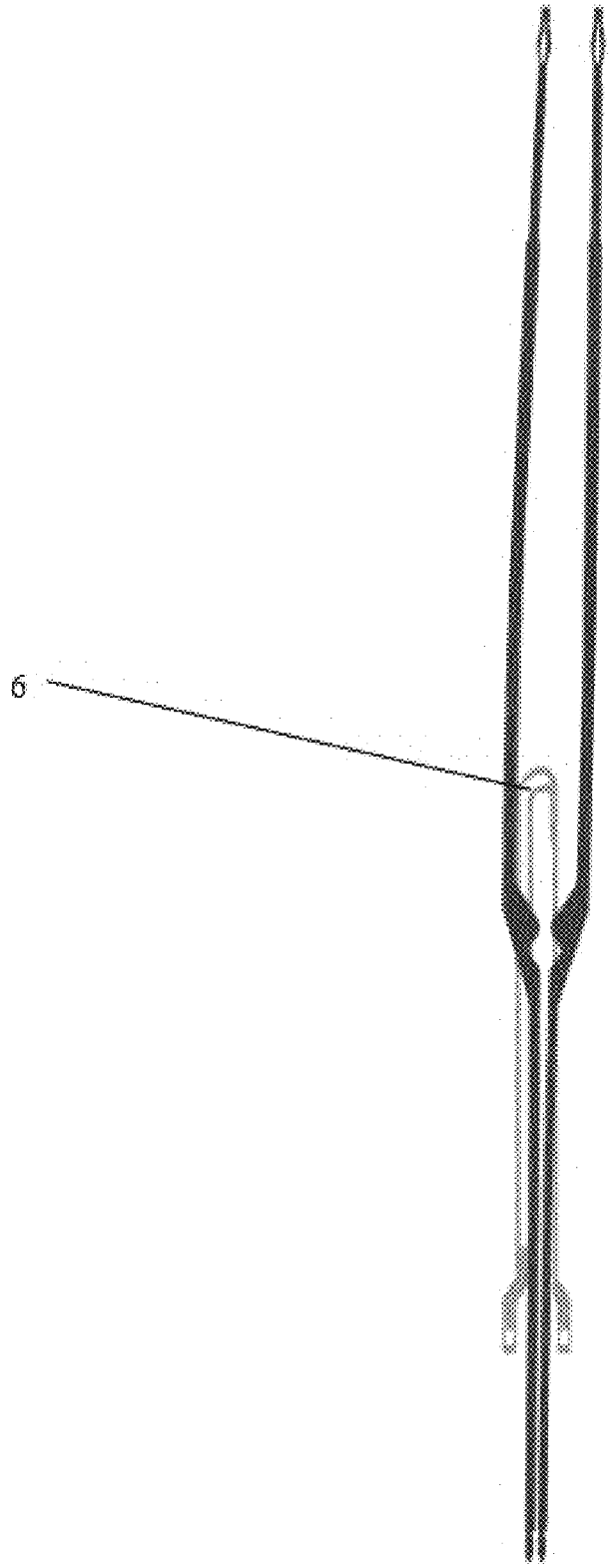
FIG. 3 is a schematic structural diagram of the assembled state of the shedding mechanism structure according to Embodiment 1 of the present application.

Referring to FIGS. 2 and 3, this embodiment provides a shedding mechanism structure 19, wherein the shedding mechanism structure 19 comprises independently liftable shedding arms and a half shedding frame 17. The shedding arms comprise a front base shedding frame 4 and a rear base shedding frame 5, both of which are provided with a movable part 7. The movable part 7 is provided with a movable hole. The half shedding frame 17 is liftably mounted between the front base shedding frame 4 and the rear base shedding frame 5 through the movable hole. The half shedding frame 17 comprises a shedding head 9 and a shedding foot 8, and the half shedding frame 17 is further provided with a heddle eye 6.

Embodiment 2

Figure 4:
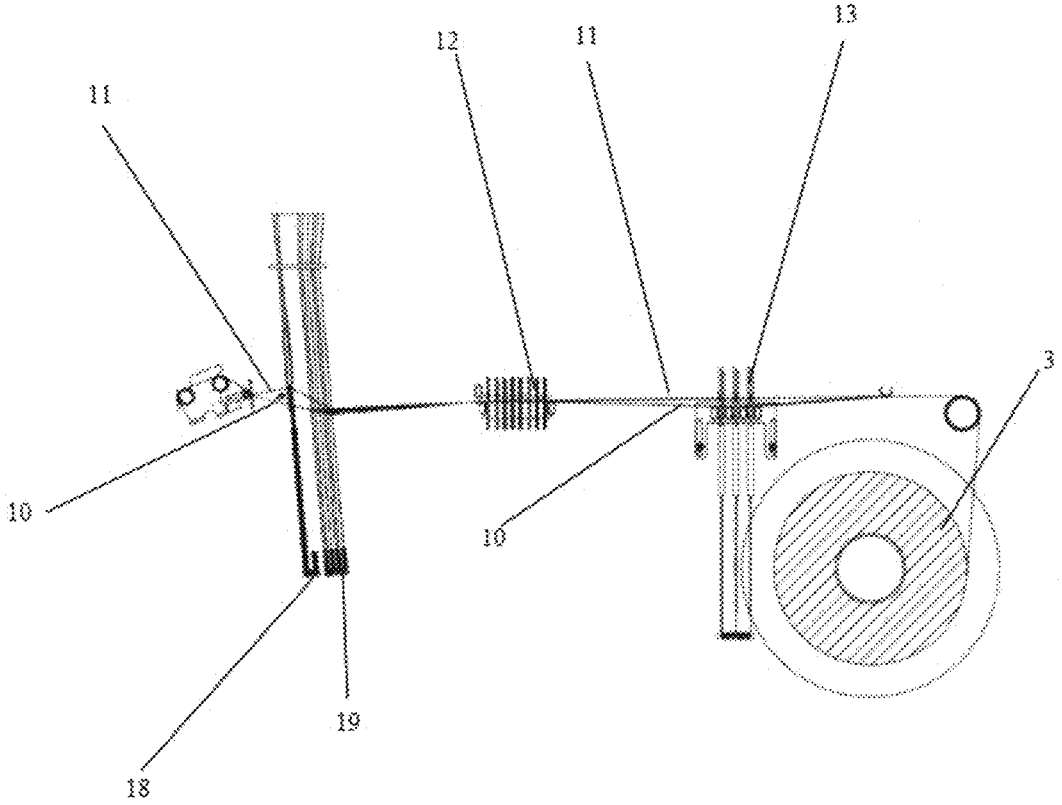
FIG. 4 is a simplified schematic structural diagram of the equipment according to Embodiment 2 of the present application.
Figure 8:
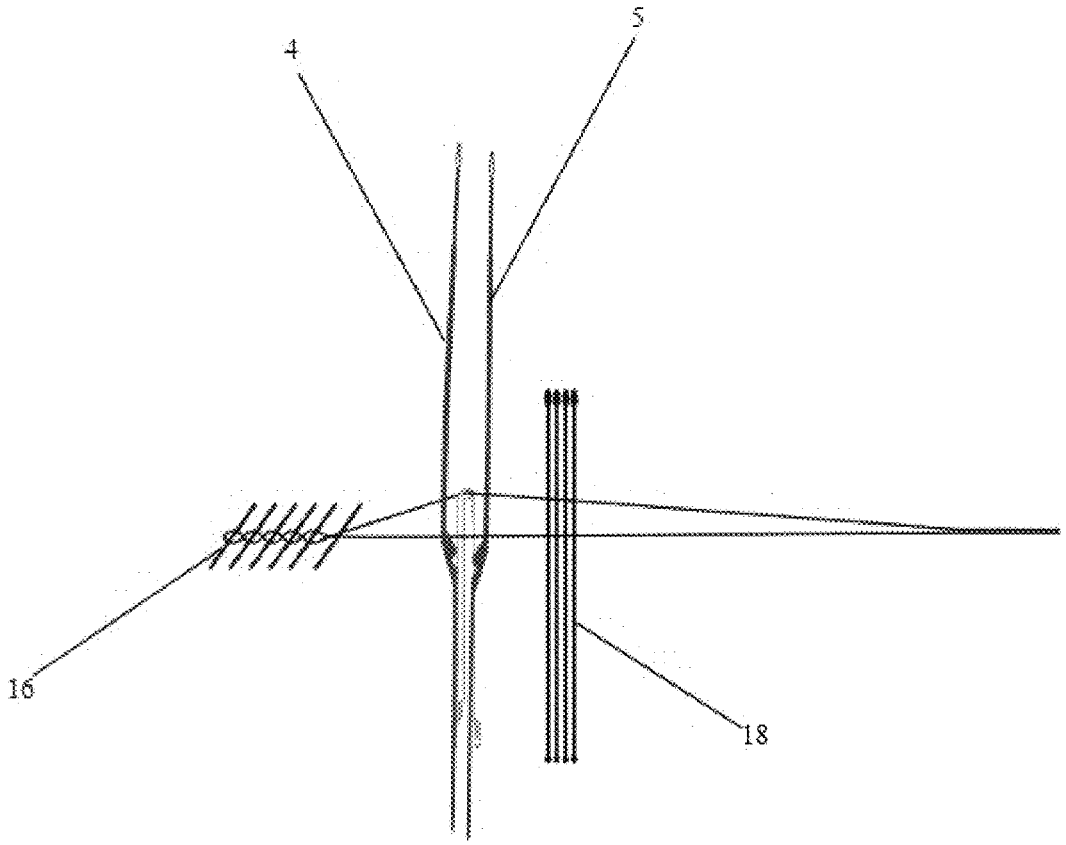
FIG. 8 is a partially enlarged schematic diagram of the shedding mechanism structure of weaving machine 2 according to the embodiment of the present application.

Please refer to FIGS. 1, 4, and 8. This embodiment provides a weaving machine provided with a shedding mechanism structure 19, comprising a machine frame that comprises a front frame body 1 and a rear frame body 2. The front frame body 1 is provided with a warp guiding mechanism, while the rear frame body 2 is provided with a warp beam 3. The warp beam 3 is configured to wind and feed the first heddled warp yarn 10 and the second heddled warp yarn 11. The warp guiding mechanism comprises a plurality of independently arrayed warp guiding components and a plurality of arrayed shedding mechanism structures 19. The weaving machine further comprises a weft insertion part for driving the weft yarn 16, a Jacquard part for connecting to one end of the warp guiding components and driving them, and a reset part for connecting to the other end of the warp guiding components and cooperating with the Jacquard part to reset the warp guiding components. The warp guiding components are configured to drive the first heddled warp yarn 10 to form a shed for inserting the weft yarn 16. The shedding mechanism structure 19 is configured to drive the second heddled warp yarn 11 to form a shed for inserting the weft yarn 16, or to drive at least two first heddled warp yarns 10 and at least one second heddled warp yarn 11 to form a shed for inserting the weft yarn 16. The warp guiding component comprises a s a liftable shedding plate and a warp guide hole provided on the shedding plate. The upper end of the shedding plate is connected to the Jacquard part, while the lower end is connected to the reset part. The upper ends of the front base shedding frame 4 and the rear base shedding frame 5 are connected to the Jacquard part, and the lower ends of the front base shedding frame 4 and the rear base shedding frame 5 are connected to the reset part. The lower end of the half shedding frame 17 is also connected to the reset part. The weaving machine further comprises a warp stop component, which comprises a first warp stop motion 12 for detecting the tension of the first heddled warp yarn 10 and the second heddled warp yarn 11 and for sending a stop signal, as well as a second warp stop motion 13 for detecting the tension of the second heddled warp yarn 11 and for sending a stop signal. The second warp stop motion is further provided with an adjustment device for adjusting the second heddled warp yarn 11. The weaving machine further comprises a control unit, which independently controls the warp guiding component and the weft insertion part.

Embodiment 3

Figure 5:
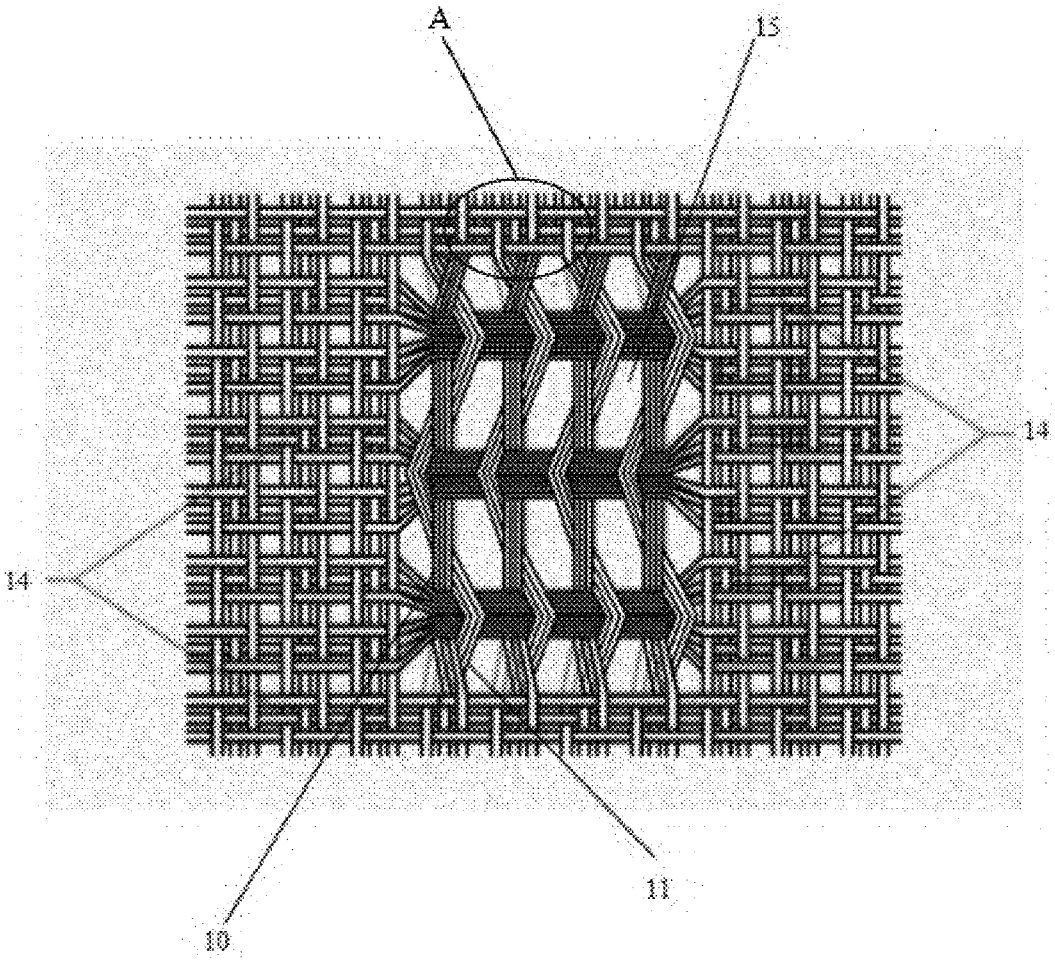
FIG. 5 is a partial schematic structural diagram of fabric 3 according to the embodiment of the present application.
Figure 6:
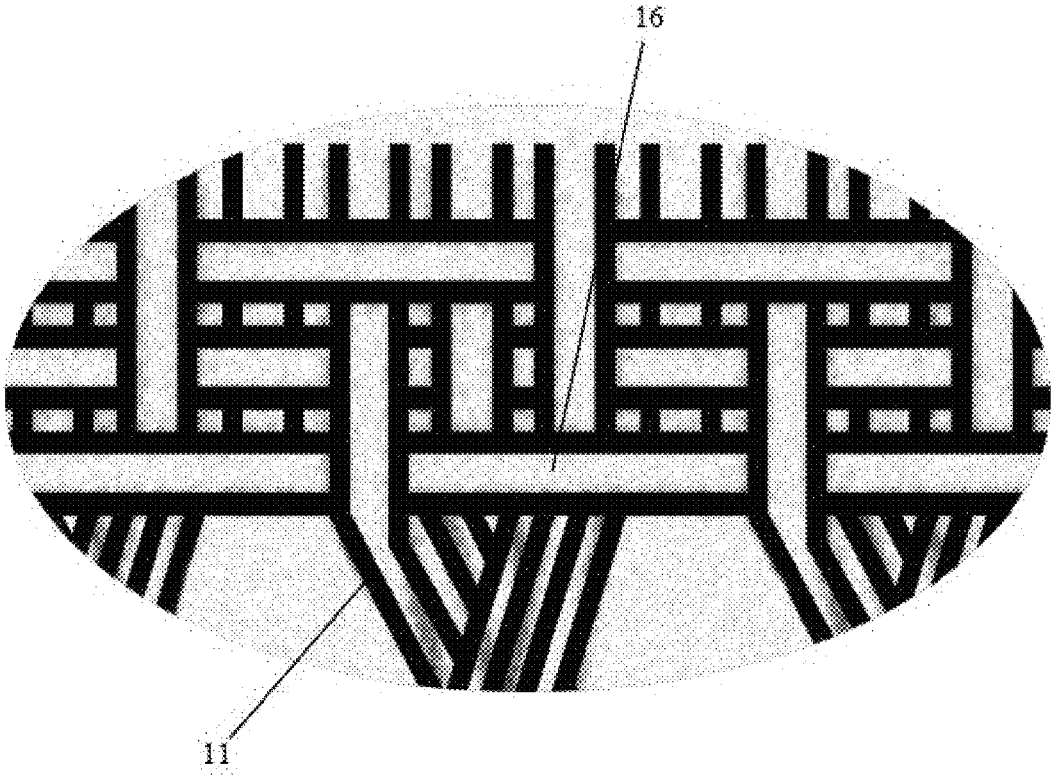
FIG. 6 is a partially enlarged schematic diagram of area A in FIG. 5 of the present application.
Figure 7:
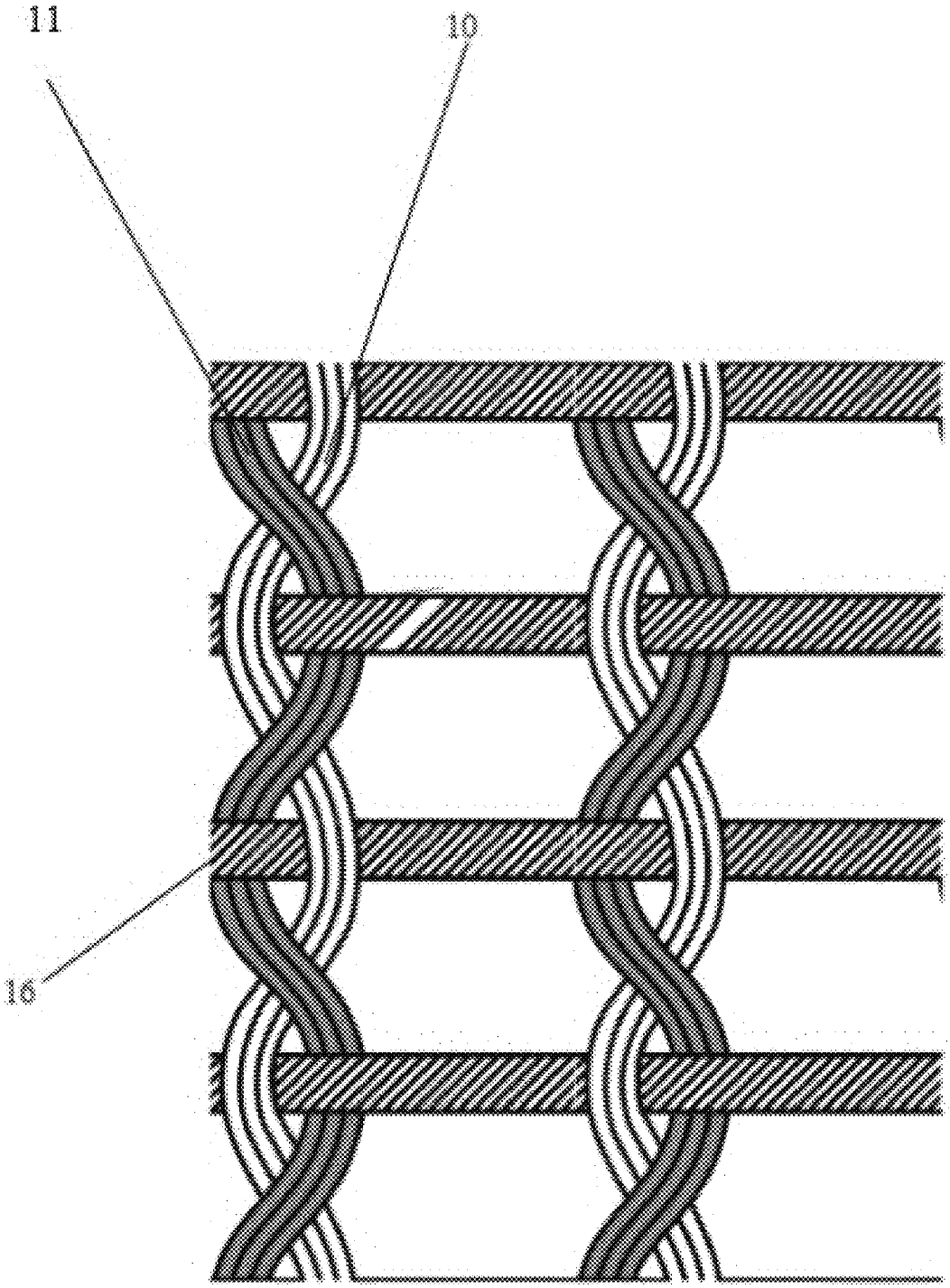
FIG. 7 is a schematic diagram illustrating the insertion of the heddled warp yarn into the weft yarn within a shedding group of the fabric in Embodiment 3 of the present application.

Referring to FIGS. 5, 6, and 7, this embodiment provides a fabric comprising a body region 14 and a mesh region, wherein the mesh region is provided with a mesh weave.

Embodiment 4

In this embodiment, the number of first heddled warp yarns 10 is three, and the number of second heddled warp yarns 11 is three.

Figure 9:
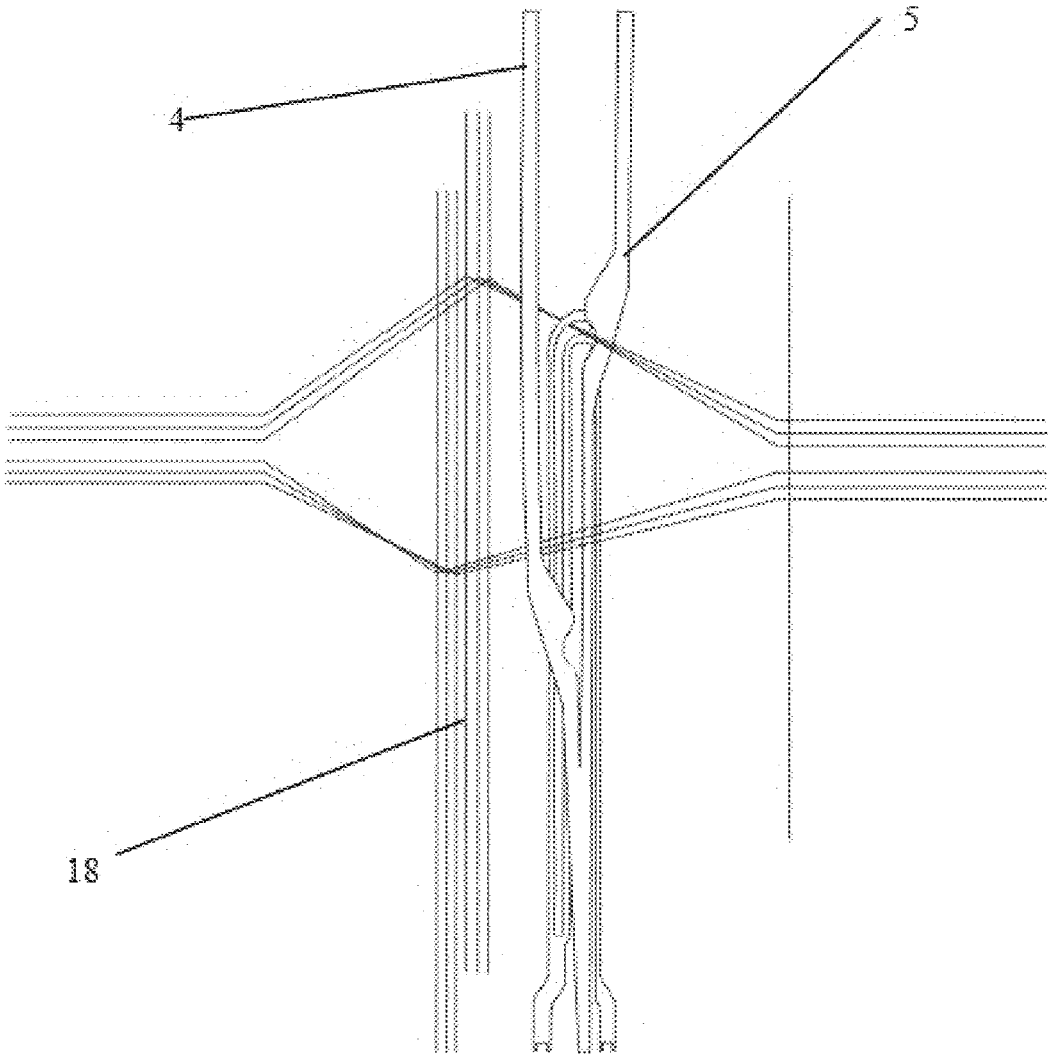
FIG. 9 is a schematic view of a heddle eye of the shedding mechanism structure in the closed state according to Embodiment 4 of the present application.
Figure 10:
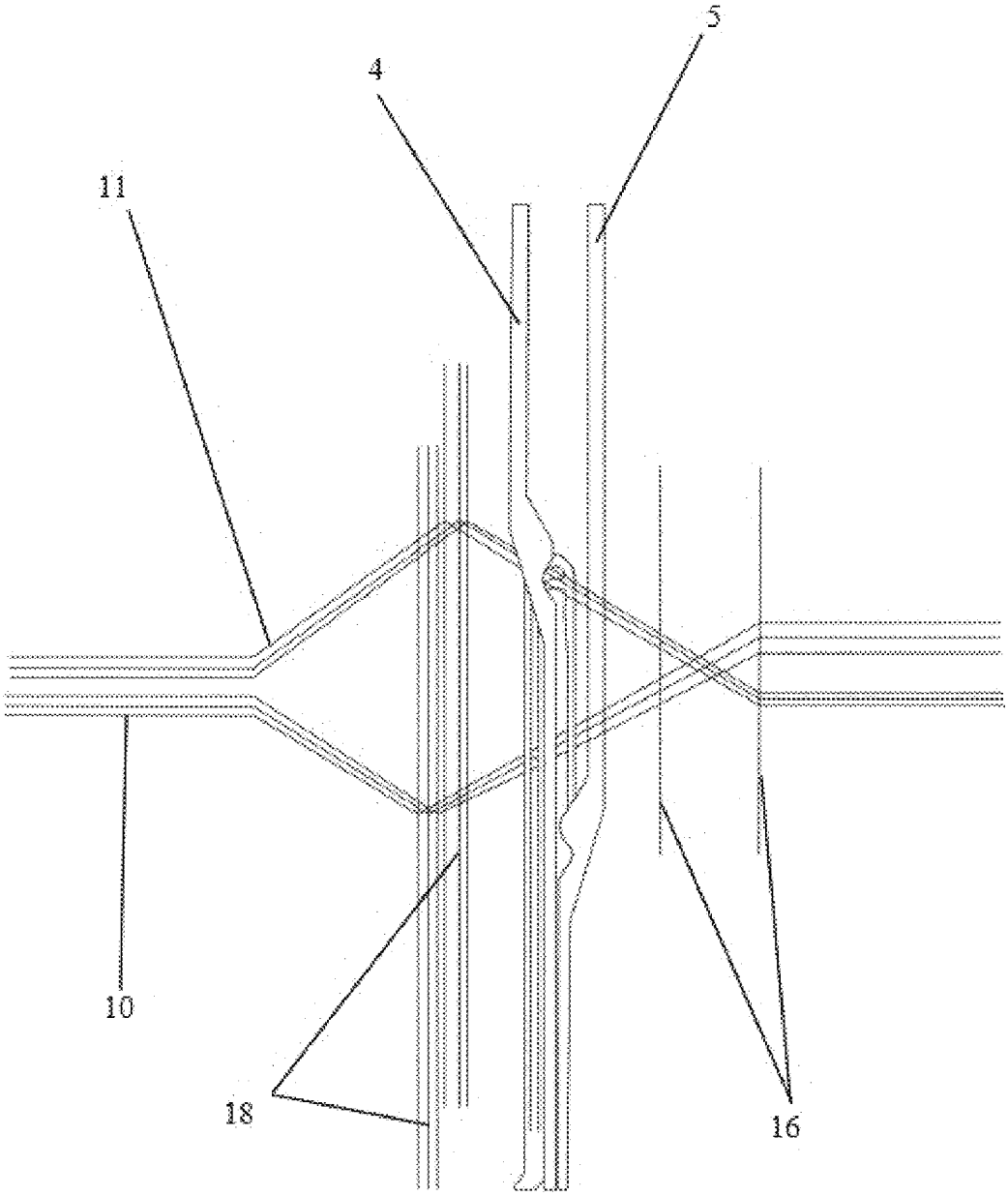
FIG. 10 is a schematic view of a heddle eye of the shedding mechanism structure in the open state according to Embodiment 4 of the present application.

Referring to FIGS. 9 and 10, this embodiment provides a method for weaving fabric utilizing a weaving machine with the shedding mechanism structure 19. The method comprises the following steps:

Weaving of the body region 14: under the condition that the first heddled warp yarn 10 and the second heddled warp yarn 11 do not interfere with each other, the ground shedding frame 18 drives the first heddled warp yarn 10 to form a shed for inserting the weft yarn 16, while the shedding mechanism structure 19 drives the second heddled warp yarn 11 to form a shed for inserting the weft yarn 16, thereby interlacing to form the fabric body region 14;

Weaving of the mesh region: Three of the first heddled warp yarns 10 are selected as the first unit warp bundle, such that the second heddled warp yarn 11 and the first unit warp bundle form a shed for inserting the weft yarn 16. The Jacquard part and the reset part drive the shedding mechanism structure 19 to adjust the relative positions of the first heddled warp yarn 10 and the second heddled warp yarn 11, thereby ensuring that the horizontal elevations of the first heddled warp yarn 10 and the second heddled warp yarn 11 differ and do not interfere with each other. The Jacquard part and the reset part drive the front base shedding frame 4 of the shedding mechanism structure 19 to raise and the rear base shedding frame 5 to fall, thereby closing the heddle eye 6 and gathering the three second heddled warp yarns 11 within the heddle eye 6 into a second unit warp bundle. Simultaneously, the first heddled warp yarn 10 raises along the edge of the half shedding frame 17 with the front base shedding frame 4 and ultimately slides between the rear base shedding frame 5 and the half shedding frame 17, such that the second unit warp bundle is entwined with the weft yarn 16 on the first unit warp bundle to form a mesh weave.

During the weaving process, the front base shedding frame 4 and the rear base shedding frame 5 of the shedding mechanism structure 19 are controlled to rise or fall by means of the Jacquard part hole, thereby controlling the opening and closing of the heddle eye 6. The first heddled warp yarn 10 passes through the warp guide hole on the ground shedding frame 18 and the heddle eye 6 on the shedding mechanism structure 19, respectively. The second heddled warp yarn 11 passes through the warp guide hole of the ground shedding frame 18 and subsequently between the front base shedding frame 4 and the rear base shedding frame 5 of the shedding mechanism structure 19. The weaving body region 14 process specifically entails adjusting the relative positions of the first heddled warp yarn 10 and the second heddled warp yarn 11 via the ground shedding frame 18, thereby ensuring that the horizontal elevations of the first heddled warp yarn 10 and the second heddled warp yarn 11 are distinct and mutually non-interfering. Furthermore, the Jacquard part and reset part drive the ground shedding frame 18 to rise or fall, causing the first heddled warp yarn 10 to move synchronously with the ground shedding frame 18 to form a shed for the introduction of the weft yarn 16.

During the process of weaving the body region 14, the shedding mechanism structure 19 is derived by the Jacquard part and the reset part to lower the front base shedding frame 4 and raise the rear base shedding frame 5, thereby opening the heddle eye 6. At this stage, the three second heddled warp yarns 11 within the heddle eye 6 are in a dispersed, freely movable state, allowing each second heddled warp yarn 11 to be individually manipulated by the ground shedding frame 18 to form a Jacquard weave.

In this embodiment, the second heddled warp yarn 11 within the heddle eye 6 slides vertically inside the heddle eye 6 as the front base shedding frame 4 moves up and down. The first heddled warp yarn 10, located outside the heddle eye 6, slides vertically between the front base shedding frame 4 and the half shedding frame 17 as the front base shedding frame 4 falls. When the front base shedding frame 4 reaches its uppermost position, the first heddled warp yarn 10 slides along the edge of the half shedding frame 17 to the space between the rear base shedding frame 5 and the half shedding frame 17, as shown in FIG. 9.

During the weaving process, the present application enables independent raising or lowering of the front and rear base shedding frames 5 of the shedding mechanism structure 19 via the Jacquard part and the reset part, thereby controlling the opening and closing of the heddle eye 6. The configuration of the heddled warp yarn within the heddle eye 6 can be adjusted according to actual weaving requirements, allowing the resulting fabric to exhibit a greater diversity of structural patterns and enhancing the fabric's sense of layering.

The present application configures the shedding mechanism structure 19 with three independent movable parts, thereby enabling, during the weaving process, the opening and closing of the heddle eye 6 to be controlled by the movement of the front and rear base shedding frames 5. This allows the heddled warp yarn within the heddle eye 6 to be gathered or dispersed. The heddle eye 6 can accommodate two or more heddled warp yarns, and, through the vertical movement of multiple ground shedding frames 18, a shed for inserting the weft yarn 16 can be formed, thereby enabling the weaving of multiple fabric patterns within a single shedding group.

The foregoing are merely preferred Embodiments of the present application and are not intended to limit the present application. Any modifications, equivalent substitutions, or improvements made within the spirit and principles of the present application shall be encompassed within the scope of protection of the present application.

What is claimed is:

1. A weaving machine with a shedding mechanism structure, comprising a machine frame, wherein the machine frame comprises a front frame body and a rear frame body, the front frame body is provided with a warp guiding mechanism, and the rear frame body is provided with a warp beam, the warp beam is configured to wind and feed a first heddled warp yarn and a second heddled warp yarn, the warp guiding mechanism comprises a plurality of independently arrayed ground shedding frames and a plurality of shedding mechanism structures, wherein during the weaving process, the opening and closing of a heddle eye can be controlled by the movement of the front frame body and the rear frame body, thereby gathering or dispersing the heddled warp yarns within the heddle eye, the heddle eye can accommodate more than two heddled warp yarns, and, by lifting the plurality of ground shedding frames up and down, a shed capable of inserting the weft yarn is formed, enabling multiple weave patterns of heddled warp yarns to be woven within a single shedding group, wherein the shedding mechanism structure comprises independently liftable shedding arms and a half shedding frame, the shedding arms comprise a front base shedding frame and a rear base shedding frame, the half shedding frame comprises a shedding head and a shedding foot, the shedding head is provided with a heddle eye of the shedding head, the heddle eye extends downward to the shedding foot, wherein the front base shedding frame and the rear base shedding frame are each provided with a movable part, the movable part is provided with a movable hole, the half shedding frame is liftably mounted between the front base shedding frame (4) and the rear base shedding frame through the movable hole.

2. The weaving machine with the shedding mechanism structure according to claim 1, further comprising a weft insertion part for driving the weft yarn, wherein one end of the ground shedding frame is connected to a Jacquard part for driving the ground shedding frame, and the other end of the ground shedding frame is connected to a reset part for resetting the ground shedding frame.

3. The weaving machine with the shedding mechanism structure according to claim 2, wherein the ground shedding frame comprises a liftable shedding plate and a warp guide hole provided on the shedding plate, wherein an upper end of the shedding plate is connected to the Jacquard part and a lower end of the shedding plate is connected to the reset part, upper ends of the front base shedding frame and the rear base shedding frame are connected to the Jacquard part, while lower ends of the front base shedding frame, rear base shedding frame, and half shedding frame are connected to the reset part.

* * * * *